US005342997A

United States Patent [19]

Kanno et al.

[11] Patent Number: 5,342,997

[45] Date of Patent: Aug. 30, 1994

[54] TAPE WIRE AND A METHOD OF MANUFACTURE THEREOF

[75] Inventors: Toshiaki Kanno; Akira Ikegaya; Tsuneyuki Horiike, all of Shizuoka, Japan

[73] Assignee: Yazaki Corporation, Tokyo, Japan

[21] Appl. No.: 1,557

[22] Filed: Jan. 6, 1993

[30] Foreign Application Priority Data

Jan. 31, 1992 [JP] Japan ..... 4-016493

[51] Int. Cl.[5] ..... H01B 7/08; H01B 13/06

[52] U.S. Cl. ..... 174/117 FF; 156/51; 174/117 F

[58] Field of Search ..... 174/117 R, 117 F, 117 FF, 174/117 A; 156/51

[56] References Cited

U.S. PATENT DOCUMENTS 3,168,617 2/1965 Richter ..... 174/117 FF
3,763,306 10/1973 Marshall ..... 174/117 F X
5,250,127 10/1993 Hara ..... 174/117 FF X

FOREIGN PATENT DOCUMENTS 62-74709 5/1987 Japan .
3-94722 9/1991 Japan .

*Primary Examiner*—Morris H. Nimmo
*Attorney, Agent, or Firm*—Finnegan, Henderson, Farabow, Garrett & Dunner

[57] ABSTRACT

The insulating members, almost circular or oval in cross section with an outer diameter virtually equal to the thickness of the rectangular conductor, are arranged in such a manner as to be alternated with the rectangular conductors and are held between the two insulating tapes from both the upper and lower sides, with the adhesive layer filling the space between the two facing tapes. The insulating tapes with adhesive layers on the opposing inner sides are pressed against the conductors and the insulating members by the press-forming rollers to form a tape wire.

6 Claims, 6 Drawing Sheets

TAPE WIRE AND A METHOD OF MANUFACTURE THEREOF

BACKGROUND OF THE INVENTION

1. Field of the Invention

This invention relates to a tape wire for use mainly on automotive wiring harness which has an increased conductor cross section and an improved allowable current and also relates to the method of manufacturing such a tape wire.

2. Description of the Prior Art

The tape wires were developed mainly for wiring in commercial equipment. Most of such tape wires consist of signal conductors, each about 0.01 $mm^2$ in cross section, held and bonded between insulating tapes from both sides. Each conductor is about 0.1 mm thick. When this tape wire is to be used in power circuits of automotive wiring harness, a conductor of at least 1.25 $mm^2$ in cross section is required, considering the allowable currents. With conventional conductors about 0.1 mm thick, however, the conductor width becomes as large as more than 12.5 mm, reducing the circuit integrity. If it is attempted to reduce the wire width by increasing the conductor thickness, a conventional manufacturing method may cause an undesired situation. That is, as shown in FIG. 6, when a conductor a is bonded with insulating tapes b, a gap c where there is no bonding agent may be formed at the side edge portion $a_1$ of the conductor. Possible ingress of water into such gaps will result in corrosion and other electrically detrimental conditions.

To circumvent this problem, a tape wire has been proposed (Japanese Utility Model Preliminary Publication No. Showa 62-74709) in which the side edge of the conductor a is worked into a knife edge $a_2$, as shown in FIG. 7, to prevent formation of the air gap at the side edge of the conductor.

However, forming the side edge of the conductor a into a knife edge $a_2$ deteriorates productivity, increasing cost.

Another tape wire is also proposed (Japanese Utility Model Preliminary Publication No. Heisei 3-94722), in which an insulating member d virtually as thick as the conductor a is interposed between the conductors a to make the tape wire uniform in thickness as shown in FIG. 8 so that the pressing force with which the insulating tape b is bonded is equal over the entire surface.

However, when the tape wire of FIG. 8 is used in automobiles and repetitively subjected to lateral bending and friction during installation and to vibrations during operation of the car, stress concentrates at the edge portion $a_3$ of the conductor a, breaking the insulating tape b and exposing the conductor a, as shown in FIG. 9. This construction has low durability.

When the cross section of the interposed insulating member d is made closer in shape to a square to reduce the intervals between the conductors a, it becomes difficult to arrange them orderly, significantly degrading the productivity in the manufacturing process.

SUMMARY OF THE INVENTION

This invention is intended to provide a tape wire which solves the above problems, is used on power circuits requiring a large current, prevents breakage of insulating member, and has high durability and reliability. It also provides a highly productive method of manufacturing such a tape wire.

To achieve the above objective, the tape wire of this invention comprises, as stated in claim 1: a plurality of parallelly arranged conductors; insulating tapes holding the conductors therebetween from both the upper and lower sides; an adhesive layer interposed between the facing insulating tapes; and insulating members almost circular or oval in cross section, the insulating members each having the outer diameter almost equal to the thickness of the conductor, the insulating members being arranged in such a way as to be alternated with the conductors.

The method of manufacturing a tape wire, as stated in claim 2, comprises the steps of: feeding to press-forming rollers a plurality of parallelly arranged conductors, insulating members and two insulating tapes in such a way that the insulating members are alternated with the conductors, the insulating members being almost circular or oval in cross section and having an outer diameter almost equal to the thickness of the conductors; holding the conductors and the insulating members between the two insulating tapes from both sides thereof by the press-forming rollers; and pressing the two insulating tapes against the conductors and the insulating members by the press-forming rollers, with an adhesive layer interposed between the two opposing insulating tapes.

In this invention, since the insulating members, almost circular or oval in cross section with its outer diameter virtually equal to the thickness of the conductors, are arranged in such a way as to be alternated with the conductors which form the tape wire, the adhesive material easily fills a space surrounding the edges of the conductors between the insulating tapes until there is no air gap left at the conductor edge portion. This prevents ingress of water and corrosion of the tape wire, improving the electrical reliability and increasing the speed of the manufacture.

DETAILED DESCRIPTION OF PREFERRED EMBODIMENT

Figure 1:
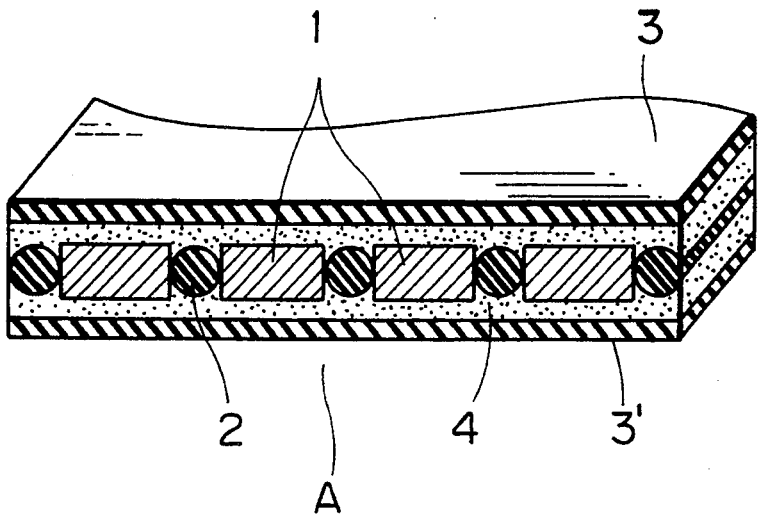
FIG. 1 is a cross section showing an essential portion of a tape wire as one embodiment of the invention.

FIG. 1 shows an explanatory view showing the cross section of the tape wire A according to this invention.

The tape wire A consists of: a plurality of conductors 1 rectangular in cross section arranged in parallel; a plurality of insulating members 2, almost circular in cross section and virtually equal in outer diameter to the thickness of the rectangular conductor 1, which are so arranged as to alternate the rectangular conductors 1; and insulating tapes 3, 3' holding the rectangular conductors 1 and the insulating members 2 from top and bottom, with an adhesive layer 4 therebetween.

The insulating member 2 is a plastic string or a synthetic fiber string or a band of fine synthetic fibers, whose diameter is almost equal to the thickness of the rectangular conductor 1. It is desirable that the entire surface or a part of the surface of the insulating member be applied with a bonding agent.

The cross section of the insulating member 2 may be formed into other shapes than a circular one, for example, an oval or other shapes similar to a circle.

Figure 2:
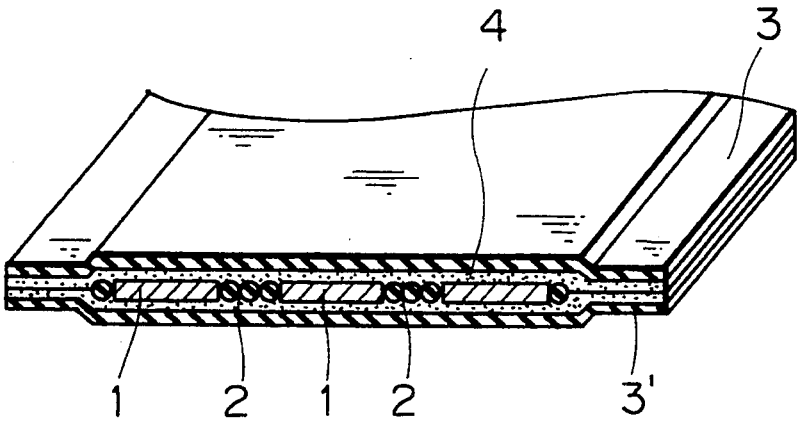
FIG. 2 is a cross section showing an essential portion of a tape wire as another embodiment of the invention.

As shown in FIG. 2, it is possible to put a plurality of insulating members 2 (for example, three strings in FIG. 2) close together according to the thickness of and the intervals between the rectangular conductors 1.

Figure 3A:
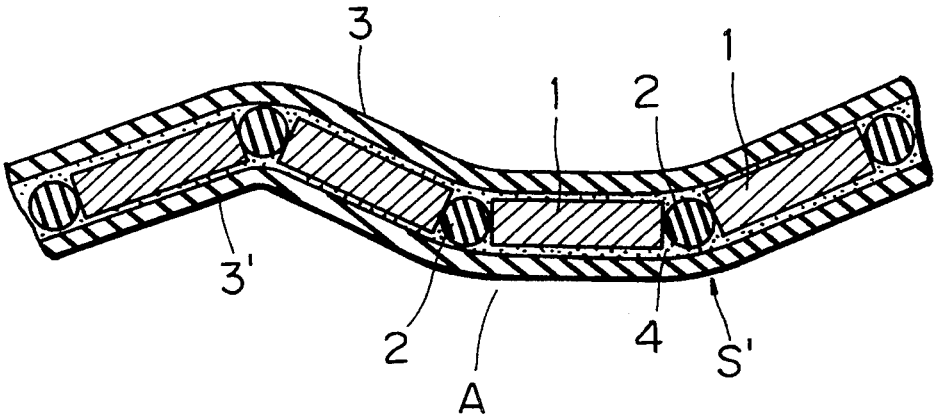
FIG. 3A and 3B show comparison between the action of the tape wire of FIG. 1 and that of the conventional tape wire.
Figure 3B:
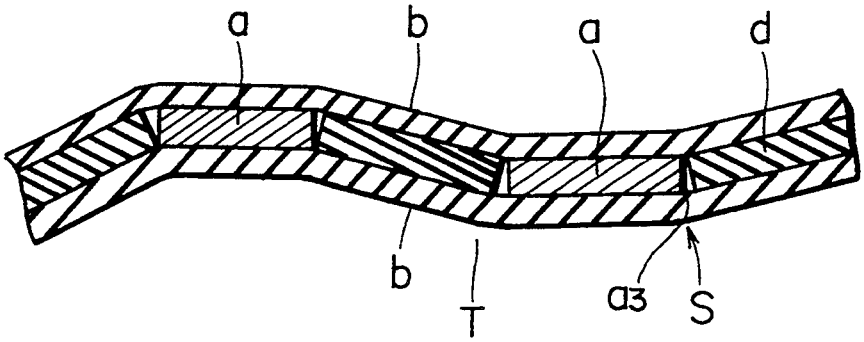
FIG. 3B PRIOR ART
Figure 8:
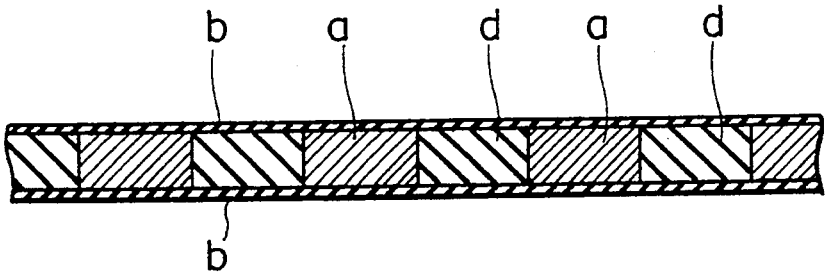
FIG. 8 PRIOR ART
FIG. 8 is a cross section of still another conventional tape wire.
Figure 9:
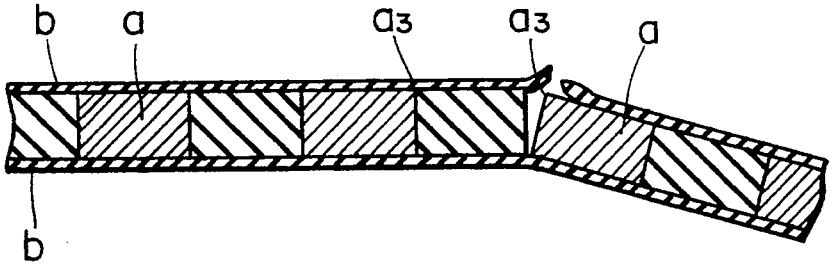
FIG. 9 PRIOR ART
FIG. 9 is a cross section showing the conventional tape wire with a broken insulating tape.

FIG. 3 shows comparison between the action of the tape wire A of this invention and that of the conventional tape wire T shown in FIG. 8. When the conventional tape wire T is laterally bent, a stress occurs at the outwardly bent portion S of the insulating tape b, as shown in FIG. 3, tending to separate the conductor a and the insulating member d from each other. This will easily break the insulating tape b at the edge portion $a_3$of the conductor a.

In this respect, since the tape wire A of this invention has the insulating members 2 virtually circular in cross section alternated with the conductors 1, the adhesive layer 4 easily fills a space around the rectangular conductor 1 and the insulating member 2, increasing flexibility of the wire. The improved flexibility prevents the outwardly bent portion S' of the insulating tape 3' from being unduly stressed so that the insulating tapes 3, 3' may break exposing the rectangular conductor 1. The durability of the tape therefore has improved.

Figure 4:
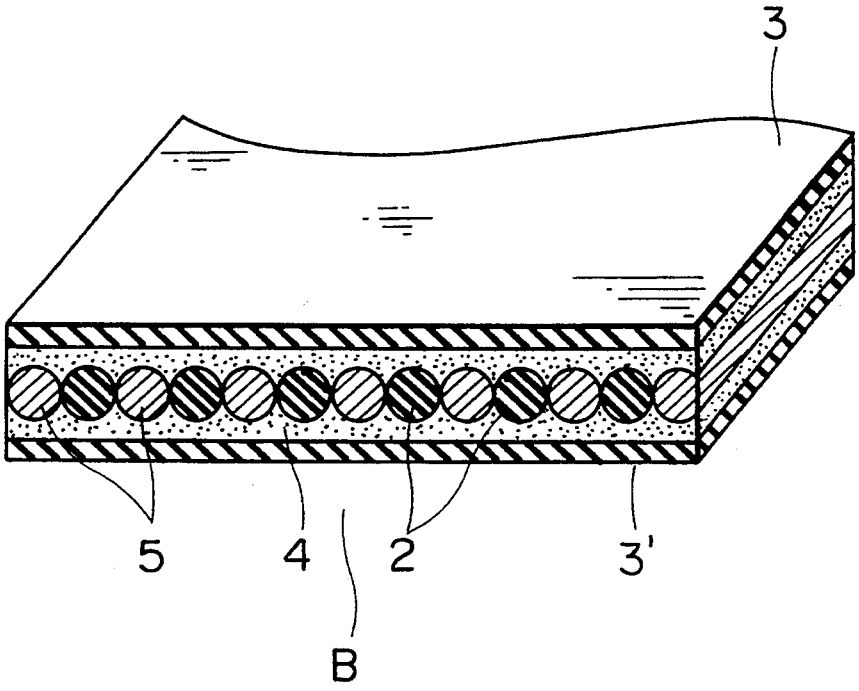
FIG. 4 is a cross section showing an essential portion of a tape wire as still another embodiment of the invention.

FIG. 4 shows another embodiment of a tape wire B, which uses round conductors 5 instead of rectangular conductors 1 of the tape wire A. In this case also, since the space surrounding the round conductors 5 and the insulating members 2 is filled with the adhesive layer 4, the resiliency of the wire increases, preventing undue stress from being applied to bent portions and therefore breakage of the insulating tapes 3, 3' and increasing durability of the wire.

Next, the process of making the tape wires A and B of this invention will be described.

Figure 5:
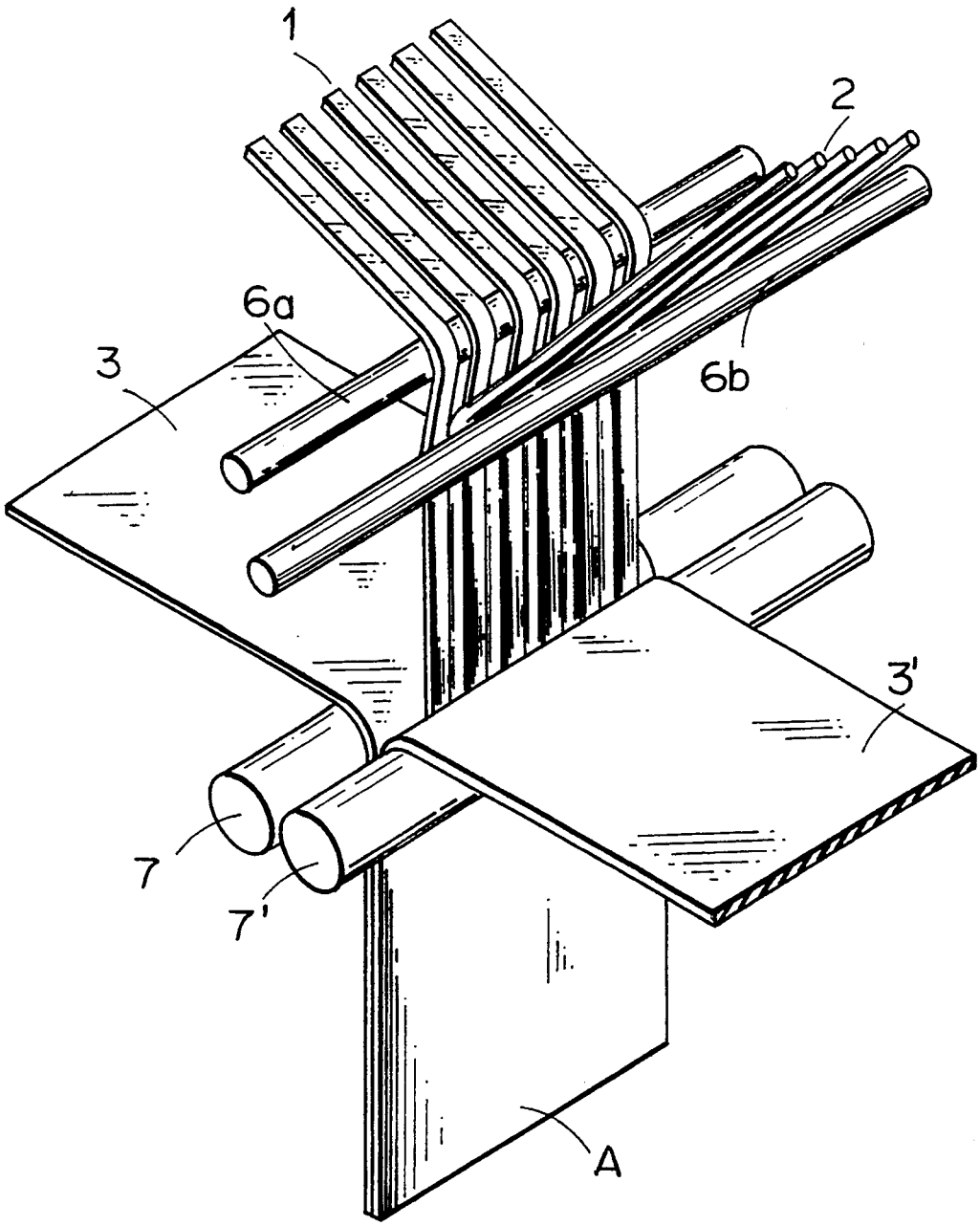
FIG. 5 is a perspective view showing the method of making a tape wire according to this invention.
Figure 6:
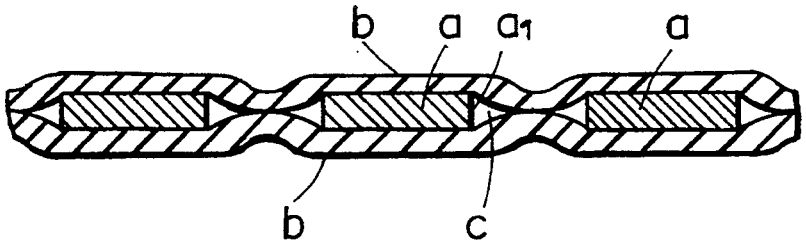
FIG. 6 PRIOR ART
FIG. 6 is a cross section of a conventional tape wire.
Figure 7:
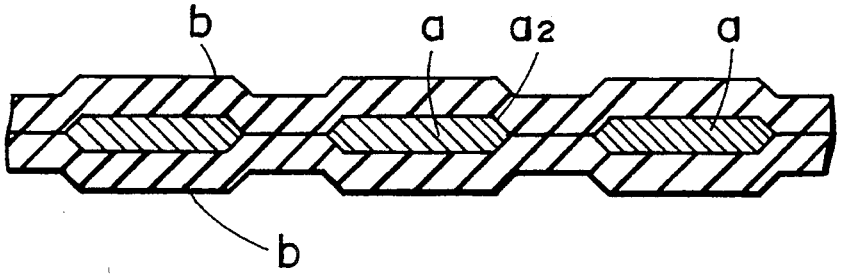
FIG. 7 PRIOR ART
FIG. 7 is a cross section of another conventional tape wire.

FIG. 5 is a perspective view showing an essential part of the tape wire manufacturing process. The parallelly arranged rectangular conductors 1 (or round conductors 5) and insulating members 2 are fed to guide rollers 6*a*, 6*b* where they are combined together in such a manner that they alternate each other before being introduced into form rollers 7, 7'. At this time, the form rollers 7, 7' are supplied with insulating tapes 3, 3' each having an adhesive layer 4. The insulating tapes hold the rectangular conductors 1 and the insulating members 2 between them and are pressed and heated by the form rollers 7, 7' to be formed into tape wires A, (B).

Because its cross section is nearly circular and has no directivity, the insulating members 2 can easily be aligned when compared with those having rectangular cross sections. This allows the form rollers 7, 7' to be operated at high speeds, increasing the productivity.

With this invention, since the insulating members, almost circular or oval in cross section with its outer diameter virtually equal to the thickness of the conductor, are alternated with the conductors which make up the tape wire, the adhesive material easily fills a space surrounding the edges of the conductors between the insulating tapes until there is no air gap left at the conductor edge portion. This prevents ingress of water and corrosion of the tape wire, improving the electrical reliability and increasing the speed of the manufacture.

The tape wire of this invention—which has its conductors increased in their thicknesses to carry large currents and is used in power circuits—has substantially improved lateral flexibility and durability against bending.

What is claimed is:

1. A tape wire comprising:

a plurality of parallelly arranged conductors;

insulating tapes holding the conductors therebetween from both the upper and lower sides;

an adhesive layer interposed between the facing insulating tapes; and insulating members almost circular or oval in cross section, the insulating members each having the outer diameter almost equal to the thickness of the conductor, the insulating members being arranged in such a way as to be alternated with the conductors.

2. A tape wire as claimed in claim 1, wherein the conductors are rectangular in cross section.

3. A tape wire as claimed in claim 1, wherein the conductors are circular in cross section.

4. A tape wire as claimed in claim 1, wherein the insulating members each comprises a plurality of insulating members put close together in a row.

5. A tape wire as claimed in claim 1, wherein the insulating members each comprises a plastic or synthetic fiber string or a band of fine synthetic fibers.

6. A method of manufacturing a tape wire comprising the steps of:

feeding to press-forming rollers a plurality of parallelly arranged conductors, insulating members and two insulating tapes in such a way that the insulating members are alternated with the conductors, the insulating members being almost circular or oval in cross section and having an outer diameter almost equal to the thickness of the conductors;

holding the conductors and the insulating members between the two insulating tapes from both sides thereof by the press-forming rollers; and pressing the two insulating tapes against the conductors and the insulating members by the press-forming rollers, with an adhesive layer interposed between the two opposing insulating tapes.

* * * * *